US005800332A

United States Patent [19]

Hensley

[11] Patent Number: 5,800,332

[45] Date of Patent: Sep. 1, 1998

[54] DECANTING CENTRIFUGE EMPLOYING ELEMENTS WITH DIFFERING RATES OF ROTATION

[76] Inventor: Gary L. Hensley, 5219 Wildblackberry Dr., Kingwood, Tex. 77345

[21] Appl. No.: 675,449

[22] Filed: Jul. 3, 1996

[51] Int. Cl.[6] ..... B04B 1/20; B04B 9/00; B04B 11/08

[52] U.S. Cl. ..... 494/53; 494/57; 494/84

[58] Field of Search ..... 494/53, 54, 56, 494/57, 58, 59, 83, 84; 210/380.1, 380.3

[56] References Cited

U.S. PATENT DOCUMENTS

| | | | |
|---|---|---|---|
| 3,228,594 | 1/1966 | Amero | 494/53 X |
| 3,279,687 | 10/1966 | Amero | 494/56 X |
| 3,279,688 | 10/1966 | Cook | 494/53 X |
| 3,532,264 | 10/1970 | Amero | 494/53 X |
| 4,464,162 | 8/1984 | Cummings | 494/53 |
| 4,566,873 | 1/1986 | Toda | 494/53 |
| 5,542,903 | 8/1996 | Nishida et al. | 494/56 X |

FOREIGN PATENT DOCUMENTS

| | | | |
|---|---|---|---|
| 640398 | 3/1995 | European Pat. Off. | 494/53 |
| 6404184 | 11/1964 | Netherlands | 494/53 |
| 1059355 | 2/1967 | United Kingdom | 494/53 |

*Primary Examiner*—Charles E. Cooley
*Attorney, Agent, or Firm*—Gunn & Associates,P.C.

[57] ABSTRACT

A method and apparatus for separating solids from a liquid in a slurry using a centrifuge employing two simultaneous rates of rotation is disclosed. In the preferred form, the device includes an external bowl having at one end a hub with a central trough therein, plural passages from said trough through said hub extending radially outwardly to contact newly delivered slurry against the wall of the bowl, the wall comprising an elongate right cylinder construction terminating at a flange. A second portion of the bowl is tapered on the exterior and defines a rising beach portion on the interior. Inside, an elongate screw conveyor is deployed and is driven by the input velocity of an external motor rotating said bowl and said conveyor. The shaft connects to the conveyor through a differential motor which provides a scrolling speed of up to about 10 rpm. At the remote end, the conveyor tapers to cooperate with the beach portion of the bowl to scroll dry solids onto the beach and through an outlet. A skimmer chamber with a skimmer is incorporated to remove liquid.

6 Claims, 3 Drawing Sheets

DECANTING CENTRIFUGE EMPLOYING ELEMENTS WITH DIFFERING RATES OF ROTATION

BACKGROUND OF THE DISCLOSURE

This disclosure is directed to a centrifuge and sets forth in particular an improved centrifuge which represents a significant departure from centrifuge construction that has prevailed in the past. It is directed to a centrifuge which is able to separate sediment in a liquid so it extracts a relatively dry solid. It is especially useful for separating particulate materials from a liquid in which the liquid is substantially water, having by definition a specific density of 1.0 and removing from the liquid particles which have a density only slightly greater as for example 1.05 specific gravity. It finds substantial application in food processing applications. It is able to remove water at a relatively low cost in comparison with thermal water removal.

In the processing of substantial quantities of food products, they are grown in the field and delivered to a processing plant for some type of treatment. This is true for rice, beans, soy beans and a great number of other grain type products. The product in the field carries substantial quantities of water. In some instances, it is important to process the food products so that the dry portion is recovered and is separated from the wet portion. The dry portion incorporates the proteins of interest. Subsequent dry protein processing is less expensive in that it involves a reduced quantity of water. It is cheaper to transport because it is dry. It is also cheaper to accomplish the drying by means of centrifugal separation. This is otherwise known as decanting. In attempting to decant bean related products, a change in the water component of the decanted protein is substantially important to the economic success of the procedure. As a specific example, when soy beans are dried, it makes a significant difference in subsequent processing cost if more water is removed. A change of perhaps 5% to 15% in the amount of retained water from a centrifuge makes an overwhelming difference in subsequent cost to reduce the water content further. Consider as an example a decanting centrifuge which is provided with a throughput of 10,000 pounds per hour of beans. The heat required to accomplish the drying is quite expensive. Moreover, the subsequent heating requires an expensive set of equipment to carry out the heating cycle, and it also requires substantial energy cost for its day-to-day operation. In that context, heating and drying with natural gas or other fuels is very expensive in comparison with the operation of the centrifuge described in the present disclosure. It is able to provide an improved performance. It is also able to provide much dryer output.

In one aspect of the present disclosure, the apparatus represents a different approach in the design of the equipment. In a typical centrifuge, there is a rotating bowl which is positioned adjacent to a cooperative conveyor. The conveyor is an elongate screw mounted on a shaft which is rotated. The complete assembly must be dynamically balanced so that it is able to rotate at several thousand rpm. In turn, this applies a relatively high G-force to the materials which are input to the structure to be subsequently separated. In the ordinary operation, such structures tend to be relatively long so that a number of turns or flites on the screw are accommodated. Ordinarily, the slurry material (a mix of liquid and particles to be separated) is input along an axial shaft through the centerline of the structure. The slurry is then flowed to the outside or toward the bowl. The heavier particulate material must migrate the greatest distance, i.e., it must flow to the bowl. Its travel is greater than the liquid. The liquid need only settle at the surface where it is subsequently removed. This type structure tends to be longer than the design set forth herein. The long design requires a longer supporting shaft which places a greater burden on the design criteria and hence requires much heavier equipment. Heavier equipment is evidenced in the bearing assemblies and mounts for the bearings to hold the shaft. The shaft must be adequately stiff. As the shaft becomes longer, it also inevitably becomes heavier. As the shaft becomes longer, the bowl is required to be longer and the residence time of a quantity introduced into the structure is much longer. For a fixed output volume, this means that the interior must be larger. The present disclosure is directed to a shorter structure. This shortens the length of the shaft between the support bearing assemblies at the respective ends. In part, this is accomplished by relocating a differential motor on the interior. Optimum operation requires that the bowl and conveyor travel at almost the same speed with a very slight difference in speed. This difference in speed must be obtained by some type of positive gear box or motor drive mechanism. A speed differential of only about 1 through about 10 rpm is required. The speed differential of 1 through 10 rpm is especially beneficial in that it initiates scrolling rotation so that the flites of the conveyor screw engage the solid particulate material and force that material up on the beach. This is the term applied to the high and dry end of the bowl. The rotating bowl is partly an elongate right cylinder construction except one end is termed the beach. The beach end of the bowl tapers to a smaller diameter. So to speak, it is high and dry in comparison with the levels of liquid which are supported in the rotating bowl.

When a slurry is introduced into the rotating bowl, it is normally conveyed along the centerline shaft and is poured out through openings which enable radial flow, typically between adjacent turns of the conveyor screw. There is the need to initially accelerate the freshly introduced liquid to get it up to speed. The speed typically is in the range of several hundred to several thousand rpm. Indeed, adequate G-forces are obtained by operating at a high speed. The introduction of the radially flowed liquid into the bowl does not bring it up to speed in an adequate fashion. It is not pre-accelerated so that a substantial amount of turbulence occurs where the input slurry stream is delivered. The present disclosure sets out a distribution head with an input trough, the trough being connected with a plurality of identical radially extending passages. The passages in conjunction with a common outlet area deliver the newly input slurry immediately against the wall of the bowl, i.e., at the maximum diameter in the bowl and delivers the newly input liquid with acceleration added to the flow. This fresh input is immediately at the bowl rotational speed. That delivers the newly added materials so that the heavy solid particulate components are subjected to the maximum G-force immediately. The heavy particles are initially rotated with the maximum G-forces possible. Since there is the initial acceleration step and since the particles are initially exposed to the maximum force when brought against the rotating bowl, there is less turbulence in the area of the bowl, and there is a better initial separation, i.e., the heavier particles are driven to the maximum place from the axis and the lighter liquid is immediately directed toward the top surface of the rotating slurry. This shortens the residence time and therefore reduces the aggregate internal volume of the bowl while yet providing a higher relative output from the decanting centrifuge.

In another aspect to the present disclosure, the deployment of the scrolling motor to the interior shortens the length of equipment which is rotated and thereby reduces the amount of material required for the central shaft which is the structural backbone of the device. As will be understood, the materials are subjected to very high G-forces which means that the structure must be designed with substantial strength so that it does not become overly stressed during operation. This requires the use of high quality materials for construction. High strength materials also must be provided with a surface which is relatively unaltered by the products which are processed in the decanting centrifuge. In effect, this requires a very high quality steel body. The preferred form is stainless steel of a selected grade to provide the relatively high yield levels necessary for its construction. Given this relatively expensive type material and accomplishing a reduction in length, the total rotated mass is significantly reduced and power consumption is reduced in the unit itself. Moreover, the output product is dried with a better measure of dryness so that subsequent processes to drive off any water remaining are reduced in cost.

In another aspect of the improved system set forth, the system utilizes an adjustable skimmer which controls the rate at which liquid flows up onto the beach. By optimal positioning of the movable skimmer, liquid impingement in the beach area can then be controlled. This operates in conjunction with the rotating conveyor, i.e., the flites on the conveyor screw so that the liquid level in the device is controlled. By controlling the liquid level, the region of the beach is kept drier and the particulate material recovered is drier also. The enhanced dryness is accomplished in part by applying greater G-forces. The G-forces applied are in excess of 3,000 Gs, and can easily be as high as about 6,000 Gs in a typical industrial grade device. Moreover, the high G-forces are applied in the area next to the rotating bowl and this is the region at which the slurry is newly introduced. This provides a much shorter transit time for the particulate material. In other words, it does not have to settle through a deep basin of liquid. Rather, it is introduced so that the particles are at the bottom, i.e., the particles are adjacent to the bowl, and the lighter liquid is forced away from that region as the particles migrate along the bowl. This enables a separation of liquid from solids and more rapid recovery. This is one of the benefits of the shorter structure. It can actually apply larger G-forces earlier and accomplish a better separation with a shorter structure, fewer turns on the conveyor, a shorter conveyor shaft, reduced internal volume, and other benefits resultant from this type of construction.

Installation is improved in that the decanting centrifuge has a much shorter footprint when installed. Comparing well known brands of centrifuges made heretofore having equal throughput or capacity ratings, the footprint at the place of installation is significantly shorter. The present apparatus is shorter in that the space between the support bearings at the ends of the shaft is much shorter. Rather than have an outboard planetary gear box on the exterior, the gear box is integrated between the support pillow blocks anchoring the equipment. The length of the equipment in a typical factory installation is much shorter. As mentioned, the shorter footprint suggests substantial benefits in the total weight of the structure, reduced residence time and other factors referred to above.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
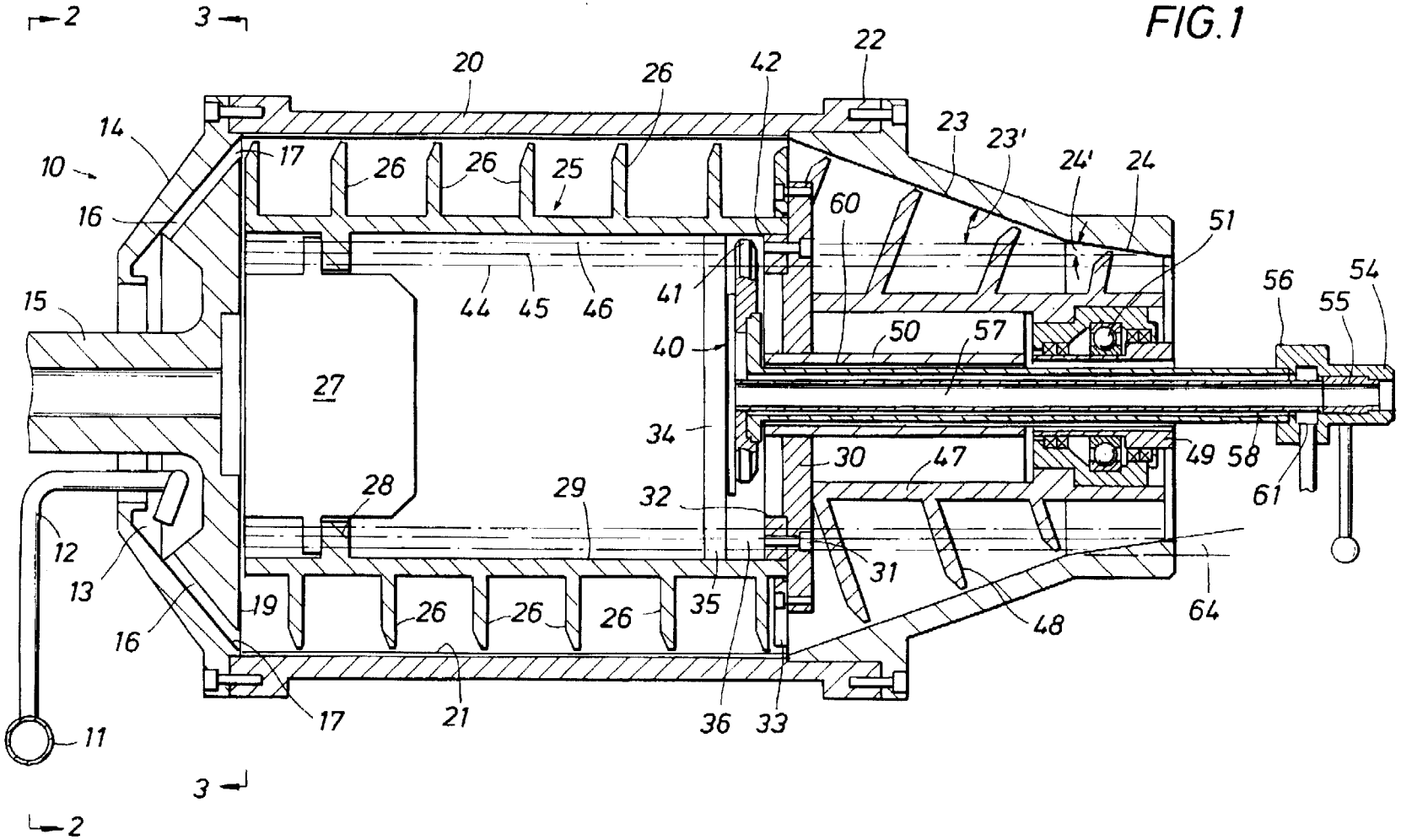
FIG. 1 is a sectional view through the length of the decanting centrifuge of the present disclosure showing details of construction thereof.

Attention is now directed to FIG. 1 of the drawings where the decanting centrifuge of the present disclosure is generally indicated by the numeral 10. It will be described as a decanter hereinafter. The decanter 10 will be described preceding substantially from left to right and beginning with the input flow or stream of slurry material. The output of the decanter is the recovered liquid which is separated from the dried particulate material. That will be referred to as solids. To set the stage, assume for purposes of description that the input is a slurry of food products including protein in a water solution. The particles making up the solids typically have a density of about 1.05 while the water defines a specific density of 1.000. Without regard to the relative mix of water and solids, the slurry is separated so that the water can be discarded or otherwise utilized, and the particulate material or the solids can be further used or processed. In the context of food processing, as the solids are made drier, downstream processing is less costly. To provide a real world example, assume for purposes of description that the solids include the fiber and protein of soy beans. The slurry is delivered through an inlet feed pipe 11 and is directed upwardly through one of several injector pipes 12. It flows downwardly into a trough 13 which is defined on the interior of a head 14. The trough 13 is circular. Here it should be noted that the liquid at any location where it is spinning is accelerated to the speed necessary to cause the liquid to cling to the surrounding cylindrical surface. Therefore, to understand the structure and how it operates, the trough 13 in FIG. 1 is spinning. In the upper portion of FIG. 1, the trough 13 appears upside down but liquid feed in the trough does not splash out. Rather, the force of gravity which would cause it to splash out if the head 13 were stationary is overcome by the spin velocity of the system. It spins so fast that the trough 13 holds the liquid in it. It is not important that a portion of the trough be upside down momentarily. To that extent, the structure must be understood to direct the spinning liquid against the inside wall of the bowl as will be described.

Figure 2:
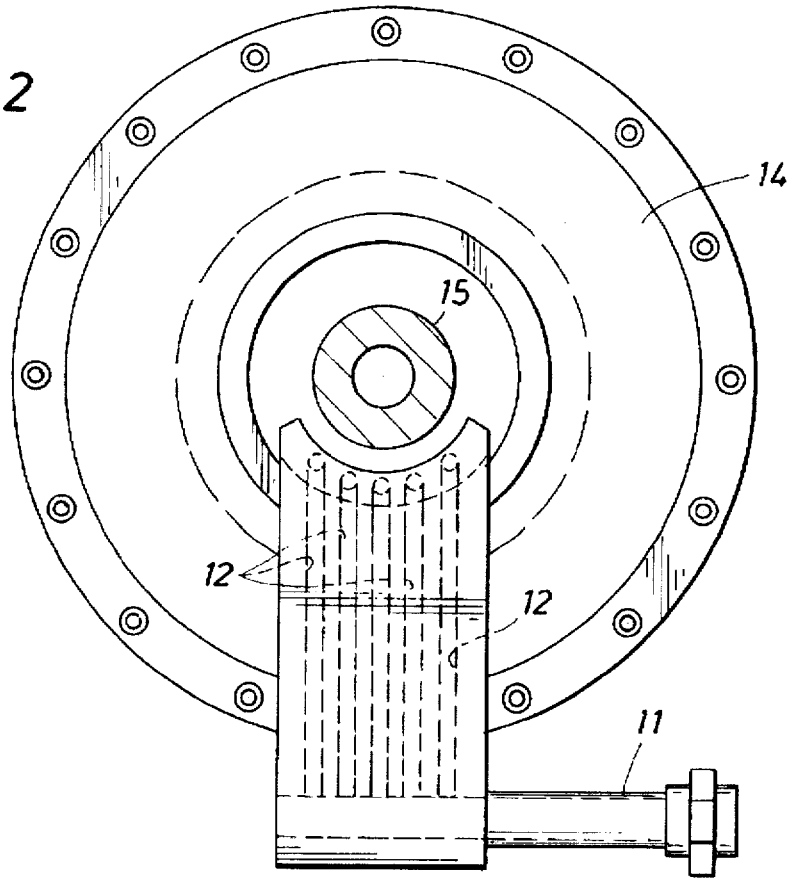
FIG. 2 is a sectional view taken along the line 2—2 in FIG. 1 of the drawings.
Figure 4:
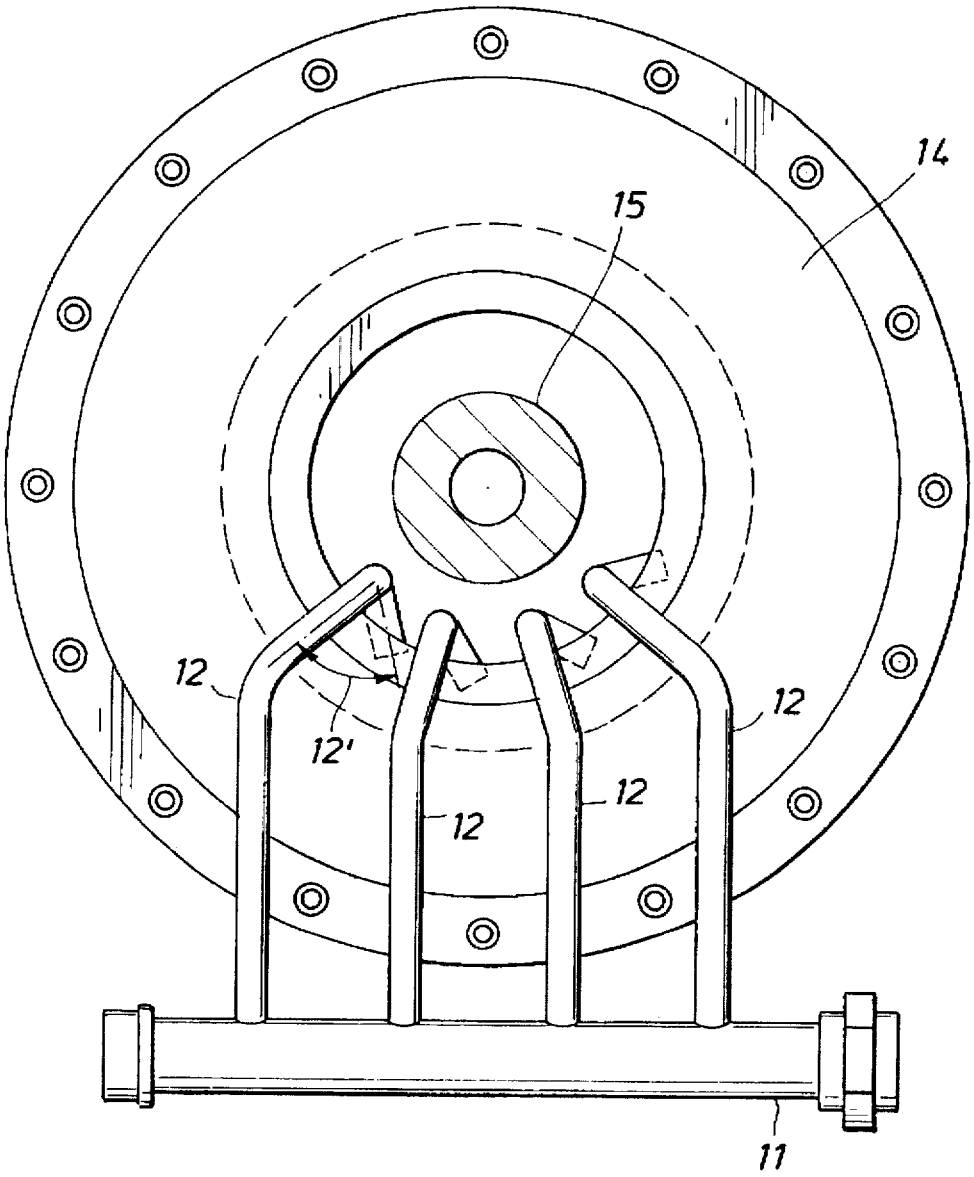
FIG. 4 is an alternate view to FIG. 3 showing a different type of header pipe providing the input slurry to the decanting centrifuge.

Going momentarily to FIG. 2 of the drawings, the line 11 is shown connected to the several lines 12 extending upwardly so that the slurry is delivered in the system. An alternate aspect of this is shown in FIG. 4. This shows individual feed pipes 12 which extend into and downwardly with respect to the trough 13. In FIG. 4, it will be noted that the several headers terminate so that the liquid flows out of the header pipes at an angle 12 '. This outward flow with an angle 12 ' helps get the flow started in circular or rotational motion. The inclined angle for the pipes 12 collaborates with the spinning trough 13 mentioned with regard to FIG. 1 of the drawings.

Figure 3:
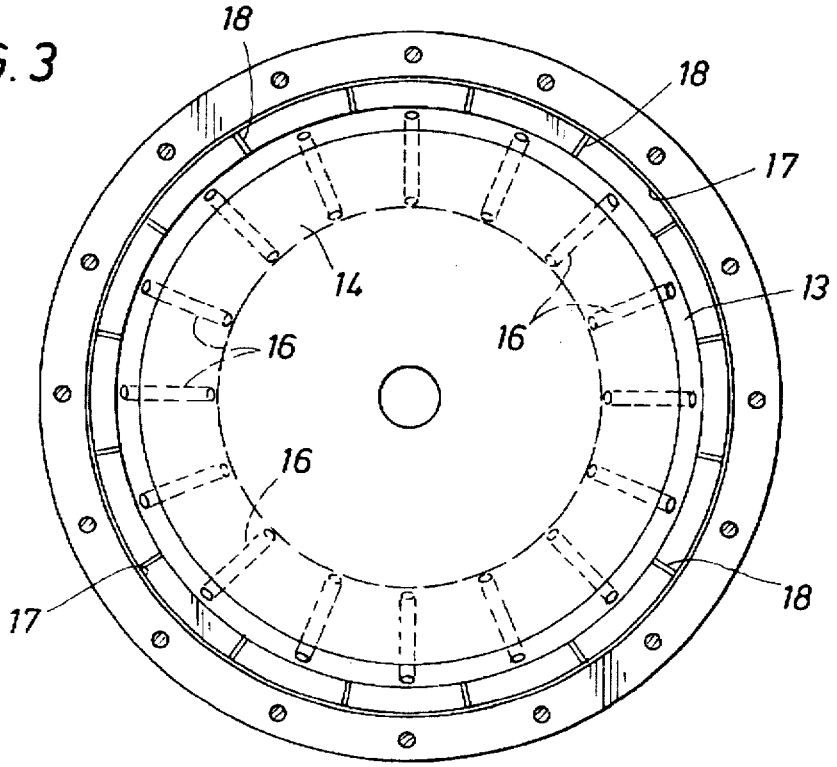
FIG. 3 is a sectional view taken along the line 3—3 in FIG. 1 of the drawings showing additional details of construction.

Continuing with the description of FIGS. 1 and 2, the head 14 is a rotating component. It is structurally constructed concentric with and extending radially outwardly from a hub. There are a number of passages 16 in the head. They extend from the trough 13 outwardly to an outlet as will be described. The head 14 is concentric about a drive shaft 15. The shaft is connected with a power plant to provide rotation. It is operated at a desired speed. The head 14 includes the several passages 16 which extend radially outwardly. Each passage is similar to the other. The several duplicate passages 16 are also shown in FIG. 3 of the drawings. FIG. 3 shows how the individual passages extend radially outwardly toward the rim of the head 14. They discharge through a common slot 17 as shown in FIGS. 1 and 3. Each passage 16 is confined between adjacent radial ribs 18 which are incorporated to impart rotation to the delivered slurry. The ribs 18 are spaced so that one is located between adjacent pairs of passages 16. The ribs 18 force the introduced slurry up to speed. Going back to FIG. 1, the slot 17 is defined in part by the deflector ring 19 shown in FIG. 1. This ring leaves a relatively thin gap or slot. In actuality, it is a circular slot but it is broken into segments by the ribs or partitions 18. This slot delivers the input slurry against the wall of the bowl as will be described. Significant advantages flow from this.

The bowl 20 as shown in FIG. 1 is an elongate, generally cylindrical structure which is made of two portions. The cylindrical portion as shown in FIG. 1 has a fixed diameter. At one end, it is bolted to the head 14. It has a ribbed side wall 21 which is made relatively strong so that it is able to hold its diameter. The wall 21 of the bowl 20 is concentric about the shaft 15 and rotates on the same axis with it. It extends to a surrounding flange 22. The flange 22 separates for assembly and services purposes. The bowl further incorporates a tapered conic section 23 which has a first tapered angle, and a second tapered section 24 which has a reduced angle. The section 23 tapers at an angle 23 ' of 20° in the preferred embodiment while the next portion 24 tapers at a reduced angle 24 '. In the preferred form the angle 24 ' is around 8°. The components are bolted together at the flange 22 so that they rotate as a unit. They will be described collectively as the bowl 20. The bowl is made concentric around the shaft 15 and rotates concentric around and adjacent to a conveyor 25.

The conveyor is constructed with a single screw on the exterior which is provided with evenly spaced flites 26. The conveyor 25 has the requisite number of flites to enable solids to travel toward the beach on the inside of the bowl. The beach 24 will be correlated to this motion in detail. Continuing however from the left end, the shaft 15 is connected with the head 14. The head is integral with the shaft in the preferred form. The integral components are bolted to the bowl 20 so that they rotate at a fixed speed determined by an external power source input through the shaft 15. Separately, the shaft 15 connects with a differential drive motor 27. In the preferred embodiment, the motor 27 is a hydraulic motor which operates at a very slight differential speed. It rotates at a controlled speed of up to about 10 or 15 rpm. In an alternative approach, a planetary gear system can be used to derive power from the shaft 15 to impart rotation with this differential to the conveyor 25. Whether a parasitic planetary gear system or an independent power source, the differential drive 27 is connected by means of a fastener lug 28 to rotate the conveyor shell 29. The conveyor shell 29 supports the flites 26 of the screw type conveyor 25 on the exterior.

Continuing with reference to FIG. 1, the bowl 20 is positioned inside a housing around the structure. That has been omitted from the drawings for sake of clarity. The bowl 20 is rotated jointly with the head 14 and shaft 15 at the left side of FIG. 1. A rotational mounting enables the bowl to rotate at a specified speed driven by a substantial power plant. A typical speed is in the range of 3,000 to 6,000 rpm. The shaft 15 is connected to the differential motor drive 27 which provides an incremental additional speed. That is adjusted to some speed between about 1 to about 10 rpm. This imparts rotation to the conveyor 25 so that it rotates on the interior of the bowl. This forms a scrolling movement forcing the solids to the right of FIG. 1. They are forced to the right on flites of the conveyor screw.

As the introduced slurry moves from left to right, it is traveling so that the solids are against the interior of the wall 21 of the bowl 20. The solids therefore experience maximum G-forces at that location. This tends to more rapidly separate the solids from the liquid. As the solids and liquid accumulate in the bowl, the solids are stratified close to the bowl while the liquids float above that. There will be some description given of the depth of liquid. For the moment, it is important to notice that the liquid is clarified as it moves to the right so that the liquid ultimately removed is substantially free of solid components.

The scrolling effect is determined by the scrolling speed input to the differential drive motor 27. That motor is connected so that it rotates with the shaft 15 and therefore rotates at the same speed as the bowl but with an additional speed subject to control of the motor 27.

As shown in the drawings, the flites are mounted on a right cylinder shell or sleeve 29. The sleeve terminates at a thick disk 30. The disk 30 terminates that portion of the conveyor having that diameter. The disk 30 is a transition piece enabling the conveyor to then taper to a smaller diameter. The disk 30 is attached to the cylindrical member 29 at a plurality of screws 31. The screws are connected to a ring 32 deployed on the interior of the cylindrical member 29 to thereby define a right cylinder construction. The disk 30 at its outer edge supports a circular lifting disk 33 which is brought near to the surrounding cylindrical portion of the housing. The aids enforcing radially inwardly the flow of decanted liquid. The disk 30 is parallel to and spaced from a cylindrical parallel disk 34. The disk 34 is fastened or integral with an interior ring 35 so that the disk 34 in conjunction with the ring 35 defines a cylindrical liquid removing chamber 36 for a skimmer. The chamber 36 is between the parallel disk 34 and 30. The chamber has a finite width to enable the chamber to receive a skimmer 40. The skimmer 40 is constructed so that it has an inlet scoop 41 located near the outer tip. It is positioned parallel to the two disk 30 and 34. It is also positioned so that it extends radially outwardly at one side. It need not be concentric with the centerline axis of the decanter 10; rather, it extends to the side in some direction so that the skimmer 40 is able to pick up liquid.

The level of liquid in the decanter 10 is adjustable. It is adjustable depending on the lateral or radial extent of the skimmer 40. It is adjustable to the extent that the skimmer interacts with the accumulated liquid so that it is removed as fast as it is added, and is removed to obtain a specified level. In particular, the screw conveyor is constructed with the elongate cylindrical member 29 which is provided with an inlet port 42 enabling any decanted liquid to accumulate to a specified height. This enables the liquid to get inside of the cylindrical member 29. It flows into the skimming chamber 36. As shown in FIG. 1 of the drawings, a maximum water depth 44 is indicated in the drawings. There is an optimum depth 45, and a minimum or lower depth 46. This shows some range of liquid depth. Again, these different depth lines are shown in the upper portion of FIG. 1. For the depth lines to be meaningful, it must be recalled that liquid accumulates inside the spinning structure. Therefore, the line 44 represents the maximum depth of liquid while the line 46 represents the minimum desirable depth. Between the lines 44 and 46, an optimum level is achieved. The opening 42 permits the decanted liquid to rise to the top free of solids and flow into the chamber 36. There, it is skimmed for removal.

In terms of relative motion, assume that the bowl is rotated at a speed of 4,000 rpm. Assume also that the conveyor on the interior is rotated at a speed of about 1 to about 10 rpm faster. Liquid is accumulated to the indicated level. It flows through the opening 42 to begin filling the chamber 36. A skimmer chamber 36 is filled from the periphery towards the center. That filling process is a result of the continued accumulation of liquid and as it rises, it rises into the chamber 36. At this juncture, it should be noted that every component just described is rotating at approximately the same velocity except the skimmer. The skimmer 41 does not rotate. Therefore, it is provided with relative rotation and is able to pick up the surface liquid decanted from the slurry and force it into the chamber. The skimming chamber 36 is provided with an outlet passage The outlet route is constructed through a set of concentric tubes. To provide some understanding of this, certain components including the bearing assemblies must be described first. That will be given below.

As mentioned earlier, the rotating bowl has a cylindrical portion and a tapered portion. The tapered portion 23 is constructed with the tapered beach 24. This requires a smaller set of conveyor flites. The conveyor is constructed primarily with uniform flite diameter at the left up to the rotating disk 30. From that point, it is constructed with a smaller cylindrical sleeve 47 which supports the tapered flites 48. They define a screw conveyor which becomes smaller at the right as shown in FIG. 1. The cylindrical support sleeve 47 is a right cylinder in the preferred form and is a support for an end located hub 49. The hub 49 is aligned with the cylindrical sleeve 47 and is supported on a bearing assembly near the hub 49. On the interior, a retainer tube 50 extends concentrically from a centerline axis opening in the disk 30. The tube 50 is joined to the disk 30 and rotates with it. The rotating hub 49 is able to support the rotating equipment on the interior by virtue of the bearing assembly 51. The bearing assembly aligns and supports so that the liquid outlet pathway can then be provided.

At the right extremity, a nut 54 threads to a threaded shaft 55 which is extended into a cylindrical enlargement 56. This serves as a liquid outlet housing. The housing 56 is enlarged and has an internal concentric area for receiving a center shaft 57 and a concentric sleeve there about at 58. In turn, this defines a passage 60 which is located so that communication is provided from the skimmer chamber 36. The chamber 36 is filled with liquid which is forced to flow out of the chamber. The skimmer 41 with its relative motion (it is stationary intercepting the rotating liquid) forces liquid into the passage 60 so that it flows out through the liquid outlet housing 56. There is an external outlet 61 which delivers the skimmed liquid.

Going now to the operation of the skimmer, it should be noted that the skimmer is able to intercept the relatively rotating decanted liquid and force it into the chamber 36, thereby creating a positive drive out of the chamber 36. This is delivered through the outlet 61 at the right hand end of the equipment. That outlet is located so that it can be connected with a fitting and hose or some other type of connection for removal of the collected liquid. Moreover, liquid skimmed from the chamber 36 is removed for subsequent disposal or use, thereby providing the dry solids as will be described. Recovered dry solids are delivered out of the system by traveling through the system in the following route. The slurry is introduced into the trough 13. The solids along with the liquid are immediately directed against the wall 21 of the rotating bowl 20. The bowl 20 is located at the termination of the radial passages 16 which provide input at the bowl. This is located so that the solids are delivered on inputting to the decanter against the bowl, i.e., they are not required to settle through an intervening layer and they are not required to decant through the liquid of material introduced earlier. As the newly introduced flow is placed in the bowl, it is put at the very location where the G-forces are maximum. From the inlet through the passages 16 and flowing past the deflector ring 19, the particles migrate to the right against the bowl while the decanted liquid migrates to the right and is floated up to one of the liquid levels 44, 45 or 46. This enables liquid to be skimmed and removed. That sequence will be detailed later. The solids continue to the right along the bowl urged by the flites 26 of the screw conveyor. They start moving up the tapered portion 23 at the urging of the conveyor flites 48. They are forced up on the beach 24. They flow along the beach 24 at the continued urging of additional recovered solids and are ejected through a slot 64 at the end of the beach 24. When ejected, the particles or solids can be removed as a major product of the disclosed system. In one aspect, the dried solids are scrolled from left to right and up on the beach 24 so that they are substantially dry. The recovered solids are drier than those ordinarily accomplished with other decanters. It is believed that the improved drying capabilities of this type structure provide that added benefit.

Liquid is decanted and removed. The liquid is forced because of its relatively lighter weight to the interior and is directed into the skimming chamber 36. That enables the liquid to be driven positively out of the structure. The rate of removal is therefore substantially dependent on the rate at which slurry is added. When slurry is added, the liquid removal with a modest time delay matches the rate of introduction.

Several advantages of this system should be noted. For one, it has the advantage of providing drier solids. If the dried solids show a 10% change in moisture content, a tremendous amount of heat savings can be achieved for subsequent liquid removal. In addition to that, the removed solids are recovered with a reduction in transit time through the structure, are recovered with an increase in G-forces forces acting on the solids, and are recovered with reduced energy expenditures. Operationally, the decanter 10 has the advantages earlier mentioned including a shorter footprint, reduced power consumption, and a relatively lighter structure. It is important to emphasize the reduction in structure. As mentioned, the length is shorter, the amount of metal required in construction is reduced, and higher G-forces can be achieved. The turbulence on the interior is reduced by directing the inlet passages 16 immediately to the bowl. The overall length is altered by locating the differential drive motor or planetary gear system 27 on the interior.

While the foregoing is directed to the preferred embodiment, the scope thereof is determined by the claims which follow:

I claim:

1. A decanter for separating solids from a liquid comprising;

(a) an elongate bowl for enclosing a slurry therein for separation;

(b) an elongate screw conveyor within said bowl mounted therein to rotate on the interior of said bowl and having flites therein providing differential movement with respect to said bowl so that solids in said bowl are moved along said bowl;

(c) a solid particle outlet from said bowl for solids scrolled along said bowl by said screw conveyor; and (d) a liquid outlet for liquid separated from solids in said bowl, wherein said bowl incorporates an end located hub and said hub supports a circular trough therein, and slurry introduced into said bowl is placed in said trough, and said trough in said hub connects with a plurality of radially directed passages extending through said hub toward a common slot in said hub so that input slurry is delivered through said passages to said common slot and then to an interior bowl wall of said bowl, and said hub extends radially outwardly to connect with said bowl wall, said bowl wall comprising an elongate right cylinder construction, and said plurality of passages extending radially outwardly to deliver slurry against said bowl wall at one end thereof, and said bowl incorporates a deflector ring which is affixed to said hub at said common slot thereby defining an inner edge of said slot and directing said slurry against said bowl wall.

2. The apparatus of claim 1 including spaced ribs affixed to said deflector ring and to said hub to partition said common slot thereby imparting rotation to said slurry and thereby direct said slurry radially outwardly into said bowl wall.

3. A decanter for separating solids from a liquid comprising:

(a) an elongate bowl for enclosing a slurry therein for separation;

(b) an elongate screw conveyor within said bowl mounted therein to rotate on the interior of said bowl and having flites therein providing differential movement with respect to said bowl so that solids in said bowl are moved along said bowl;

(c) a solid particle outlet from said bowl for solids scrolled along said bowl by said screw conveyor;

(d) a liquid outlet for liquid separated from solids in said bowl;

(e) a central shaft connected to said bowl through an end located hub to rotate said bowl; and (f) a screw conveyor differential speed motor connected between said shaft and said conveyor to drive said conveyor at a speed close to but slightly different from the speed of said bowl, wherein said screw conveyor rotates at a differential speed causing flites on said screw conveyor to scroll solids along the interior of said bowl.

4. The apparatus of claim 3 wherein said differential motor for said conveyor is mounted on the interior of said bowl and connects from said shaft to said conveyor to impart a selected differential speed.

5. The apparatus of claim 4 wherein said screw conveyor comprises an elongate central shell having a screw mounted on the exterior thereof with a plurality of said flites having a fixed and common diameter and extending along said screw, and further wherein said screw conveyor terminates in at least one of said flites is of reduced diameter to thereby enable scrolling along said conveyor and said bowl toward an end of said bowl and wherein said bowl end is raised to define a beach for drying solids.

6. A decanter for separating solids from a liquid comprising:

(a) an elongate bowl for enclosing a slurry therein for separation;

(b) an elongate screw conveyor within said bowl mounted therein to rotate on the interior of said bowl and having flites therein providing differential movement with respect to said bowl so that solids in said bowl are moved along said bowl;

(c) a solid particle outlet from said bowl for solids scrolled along said bowl by said screw conveyor; and (d) a liquid outlet for liquid separated from solids in said bowl, wherein said bowl comprising an inlet end and an outlet end and is formed of first and second portions, and the first portion thereof comprises an elongate right cylinder shell and comprises said inlet end, and said second portion comprises an outlet end and also comprises a right angle tapered shell having an interior portion thereof defining a beach for the outlet end of said bowl, and said bowl is closed at said inlet end by an end located hub having inlet means therein for receiving slurry for separation, and said outlet end of said bowl comprises said liquid outlet and said solid particle outlet and is adjacent to said beach so that dry solids can be delivered through said solid particle outlet, and said bowl is supported on a bearing assembly at said beach, and said bearing assembly is concentrically mounted about a central shaft extending into said bowl, and said shaft is provided with said liquid outlet.

* * * * *